US006212826B1

(12) United States Patent
Kimener

(10) Patent No.: US 6,212,826 B1
(45) Date of Patent: Apr. 10, 2001

(54) RECIPROCATING BARRIER ASSEMBLY

(75) Inventor: Tom Kimener, Milford, OH (US)

(73) Assignee: Midwest Industrial Door, Inc., Loveland, OH (US)

( * ) Notice: Subject to any disclaimer, the term of this patent is extended or adjusted under 35 U.S.C. 154(b) by 0 days.

(21) Appl. No.: 09/345,621

(22) Filed: Jun. 30, 1999

(51) Int. Cl.[7] ..... E05C 7/06; E05F 17/00

(52) U.S. Cl. ..... 49/97; 49/95; 49/122; 49/445

(58) Field of Search ..... 49/93–97, 404, 49/197, 199, 121–122, 445; 160/113, 114, 191, 229.1, 201, 352

(56) References Cited

U.S. PATENT DOCUMENTS

| | | | | |
|---|---|---|---|---|
| 2,226,033 | * | 12/1940 | Walling | 160/191 X |
| 3,378,059 | * | 4/1968 | Young | 160/191 X |
| 3,429,072 | * | 2/1969 | Sammons | 160/191 X |
| 4,041,646 | | 8/1977 | Mittag . | |
| 4,150,510 | | 4/1979 | Harrison et al. . | |
| 4,379,478 | * | 4/1983 | Lichy | 160/229.1 X |
| 4,422,264 | | 12/1983 | Harris . | |
| 4,538,379 | | 9/1985 | Vargo . | |
| 5,419,010 | | 5/1995 | Mullet . | |
| 5,546,703 | | 8/1996 | Conway . | |
| 5,566,740 | | 10/1996 | Mullet et al. . | |
| 5,572,829 | | 11/1996 | Stoltenberg . | |
| 5,577,544 | | 11/1996 | Carper et al. . | |
| 5,592,779 | | 1/1997 | Conway . | |
| 5,626,176 | | 5/1997 | Lewis, Jr. et al. . | |
| 5,671,500 | | 9/1997 | Balk . | |
| 5,698,073 | | 12/1997 | Vincenzi . | |
| 5,701,701 | | 12/1997 | Desrosier . | |
| 5,709,050 | | 1/1998 | Benko . | |
| 5,749,407 | | 5/1998 | Brenner et al. . | |
| 5,782,283 | | 7/1998 | Kendall . | |

OTHER PUBLICATIONS

Catalog for Roly® Safeti–Gate, 1997–1998 (Month Not Available).

Brochure for Roly® Safeti–Gate Power Model (Month Not Available).

Brochure for Roly® Safeti–Gate Pivot Model (Month Not Available).

Brochure for Roly® Safeti–Gate Tri–Side Model (Month Not Available).

Brochure for Roly® Safeti–Gate Rack Supported Model (Month Not Available).

Brochure for Roly® Safeti–Gate (Month Not Available).

* cited by examiner

*Primary Examiner*—Daniel P. Stodola
*Assistant Examiner*—Hugh B. Thompson
(74) *Attorney, Agent, or Firm*—Thompson Hine & Flory LLP

(57) ABSTRACT

The assembly includes a pair of parallel guide rails, each shaped generally as an inverted U; a first gate segment having at least one pair of rollers positioned on opposite lateral sides thereof, where each roller is received within a respective one of the guide rails so that the first gate segment is guided by the pair of guide rails; a second gate segment having at least one pair of rollers positioned on opposite lateral sides thereof, where each roller is received within a respective one of the guide rails so that the second gate segment is guided by the pair of guide rails; and at least one substantially rigid cross-bar pivotally connected between the first and second gate segments. The first gate segment is guided by the guide rails from a first barrier position in which it is positioned entirely within the front vertical portions of the guide rails to an open position in which it is positioned at least partially in the horizontal portion of the guide rails; and the second gate segment is guided by the guide rails from a second barrier position in which it is positioned entirely within the back vertical portions of the guide rails to an open position in which it is positioned at least partially in the horizontal portion of the guide rails. The cross-bar has a length which requires that when the first gate segment is in its barrier position the second gate segment will be in its open position, and vice-versa. Therefore, because the cross-bar is substantially rigid, it will restrict the first and second gate segments from being lifted simultaneously to their open positions.

17 Claims, 5 Drawing Sheets

RECIPROCATING BARRIER ASSEMBLY

BACKGROUND

The present invention is a barrier assembly protecting the edge of an elevated loading platform or mezzanine, where the loading platform is adapted to receive pallets of articles from an elevated load-in side of the loading platform, and where workers/handlers will remove the articles from a handling side of the loading platform. In particular, the present invention is a barrier assembly that provides a protective barrier on the load-in side of the loading platform when workers are removing articles from the handling side of the platform and also provides a protective barrier on the handling side of the loading platform when the articles are being loaded onto the platform by forklift trucks through the load-in side of the platform.

A typical distribution center or warehouse may include a plurality of elevated loading platforms or mezzanines that have openings on the load-in side of the loading platforms for receiving pallets of articles from forklift trucks, and that also have openings on the handling side of the loading platforms for facilitating removal of the loaded articles by workers. Even though the workers will typically remain clear from the load-in side of the loading platform while removing the articles therefrom, the openings from the load-in side of the loading platforms for receiving the pallets from the forklift trucks present a potential fall hazard for the workers. Furthermore, even though workers will typically remain clear from the loading platform while pallets are being loaded onto the platform by forklift trucks, openings into the loading platform during this operation present a potential fall hazard for the workers as well as a potential for injuries caused by the loading articles.

U.S. Pat. No. 4,422,264 discloses a safety gate assembly that includes first and second safety gates, each of which have rollers that are received within a pair of parallel, inverted U-shaped tracks. The safety gates are coupled together by cables, which are guided between the gates by pulleys positioned above the gates. When one of the safety gates is lifted (providing access to one side of the preselected area) the pulley assembly will operate so as to allow the second safety gate to be lowered into a position blocking entrance to the opposite side of the preselected area. Likewise, when the second safety gate is lifted so as to allow entrance to the preselected area, the cable and pulley assembly will operate so as to allow the first safety gate to be lowered again, thereby restricting entrance to the preselected area from its opposite position. A disadvantage with this assembly is that the cable and pulley system allows both the first and second safety gates to be lifted simultaneously, thereby facilitating easy circumvention of the protections provided by the barrier assembly. Another disadvantage with this apparatus is that the cable and pulley systems add unnecessary complexity and expense to the apparatus.

Accordingly, there is a need for a barrier assembly which provides a barrier on a handling side of an elevated loading platform when articles are being loaded onto the platform, through a load-in side of the platform, by lift trucks, and provides a barrier on the load-in side of the elevated platform when articles are being removed from the loading platform through the handling side of the platform by workers. There is also a need for such a barrier assembly which restricts the load-in side barrier and handling side barrier from being opened at the same time, and which is relatively uncomplicated in design and relatively inexpensive to build.

SUMMARY

The present invention provides a reciprocating barrier assembly that provides a barrier on a handling side of an elevated loading platform when articles are being loaded onto the platform, through a load-in side of the platform, and provides a barrier on the load-in side of the elevated platform when articles are being removed from the loading platform through the handling side of the platform by workers.

The barrier assembly includes a pair of parallel guide rails, each shaped generally as an inverted U, and having a first substantially vertical portion, a second substantially vertical portion opposite the first substantially vertical portion and a substantially horizontal portion interconnecting the first and second substantially vertical portions; a first gate segment having at least one pair of rollers positioned on opposite lateral sides thereof, where each roller is received within a respective one of the guide rails so that the first gate segment is guided by the pair of guide rails; a second gate segment having at least one pair of rollers positioned on opposite lateral sides thereof, where each roller is received within a respective one of the guide rails so that the second gate segment is guided by the pair of guide rails; and at least one substantially rigid cross-bar pivotally connected between the first and second gate segments. The first gate segment is guided by the pair of guide rails from a first barrier position in which the first gate segment is positioned entirely within the first substantially vertical portions of the pair of guide rails to an open position in which the first gate segment is positioned at least partially in the substantially horizontal portion of the pair of guide rails. The second gate segment is guided by the pair of guide rails from a second barrier position in which the second gate segment is positioned entirely within the second substantially vertical portions of the pair of guide rails to an open position in which the second gate segment is positioned at least partially in the substantially horizontal portion of the pair of guide rails. Finally, the cross-bar has a length which requires that when the first gate segment is in its barrier position the second gate segment will be in its open position, and vice-versa. Therefore, because this cross-bar is substantially rigid, it will restrict the first and second gate segments from being lifted simultaneously to their open positions.

Preferably, the cross-bar is pivotally coupled to each of the first and second gate segments, approximate a first lateral edge of the first and second gate segments, and the barrier assembly further includes a second cross-bar pivotally coupled between the first and second gate segments adjacent to an opposite lateral edge of the first and second gate segments. Furthermore, it is preferred that the barrier assembly also includes stops coupled to guide rails for restricting downward movement of the first or second gate segments when the first or second gate segments are in their respective barrier positions. It is also preferred that the barrier assembly includes a stationary support elevated above the horizontal portions of the pair of guide rails and a spring mounted between the stationary support and the cross-bar, where the spring acts to reduce the amount of force needed to lift the first or second gate segments from their respective barrier positions to their respective open positions.

Accordingly, it is an object of the present invention to provide a reciprocating barrier assembly which provides a barrier on the handling side of an elevated loading platform when articles are being loaded onto the platform by lift trucks, and provides a barrier on the load-in side of the elevated platform when articles are being removed from the loading platform through the handling side of the platform by workers. It is also an object of the present invention to provide a reciprocating barrier assembly which restricts the load-in side barrier and handling side barrier from being opened or lifted at the same time. It is also an object of the present invention to provide a reciprocating barrier assembly that is relatively uncomplicated in design and relatively inexpensive to build. These and other objects of the present invention will be apparent from the following description, the attached drawings and the appended claims.

DETAILED DESCRIPTION

Figure 1:
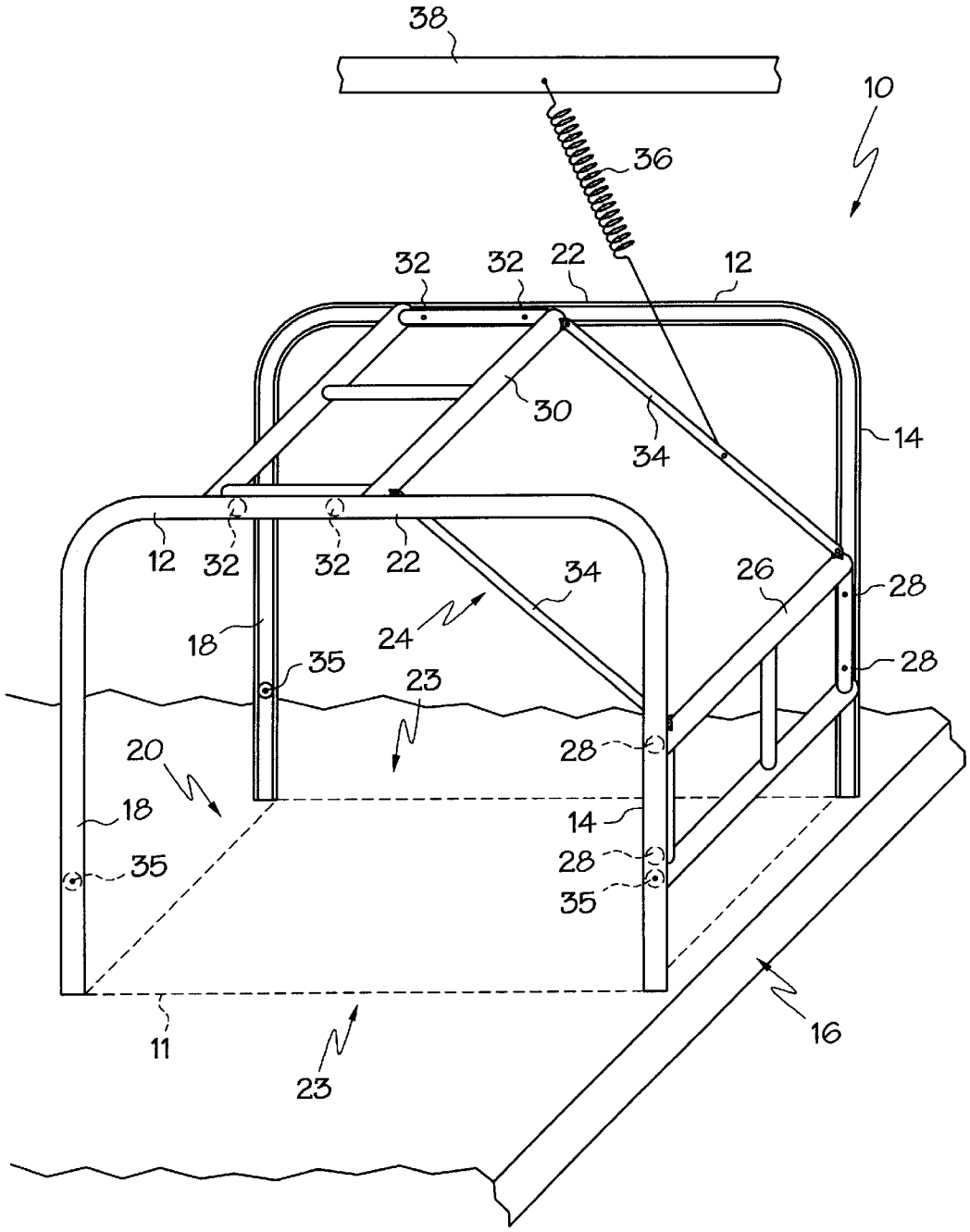
FIG. 1 is a perspective view of the reciprocating barrier assembly of the present invention.

As shown in FIG. 1, the reciprocating barrier assembly 10 of the present invention is positioned upon a loading area 11 of an elevated loading platform or mezzanine. The reciprocating barrier assembly 10 includes a pair of parallel guide rails 12 that are shaped generally as an inverted-U and have a first substantially vertical portion 14 approximate a load-in side 16 of the elevated loading platform or mezzanine, a second substantially vertical portion 18 approximate handling entrance side 20 of the elevated loading platform or mezzanine and a substantially horizontal portion 22 interconnecting the first and second substantially vertical portions. Preferably the vertical portions 18, 20 are connected to the horizontal portions 22 by curved sections of the guide rails. The guide rails are preferably constructed from conventional 3" C-channel track commonly used in overhead or garage door systems. Although not shown in FIG. 1, entrance into the loading area 11 from the lateral sides 23 of the loading area is preferably restricted by permanent barriers, which may be part of the barrier assembly 10 or part of the mezzanine construction, for example.

Figure 2B:
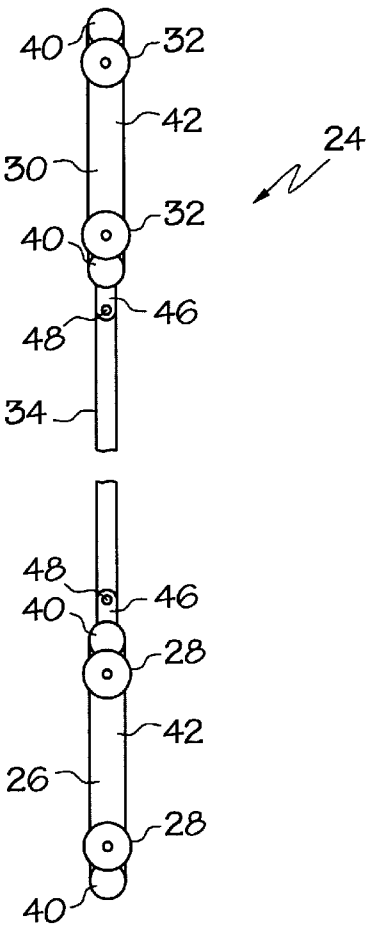
FIG. 2B is a side view of the multi-segmented barrier gate of FIG. 2A.
Figure 2A:
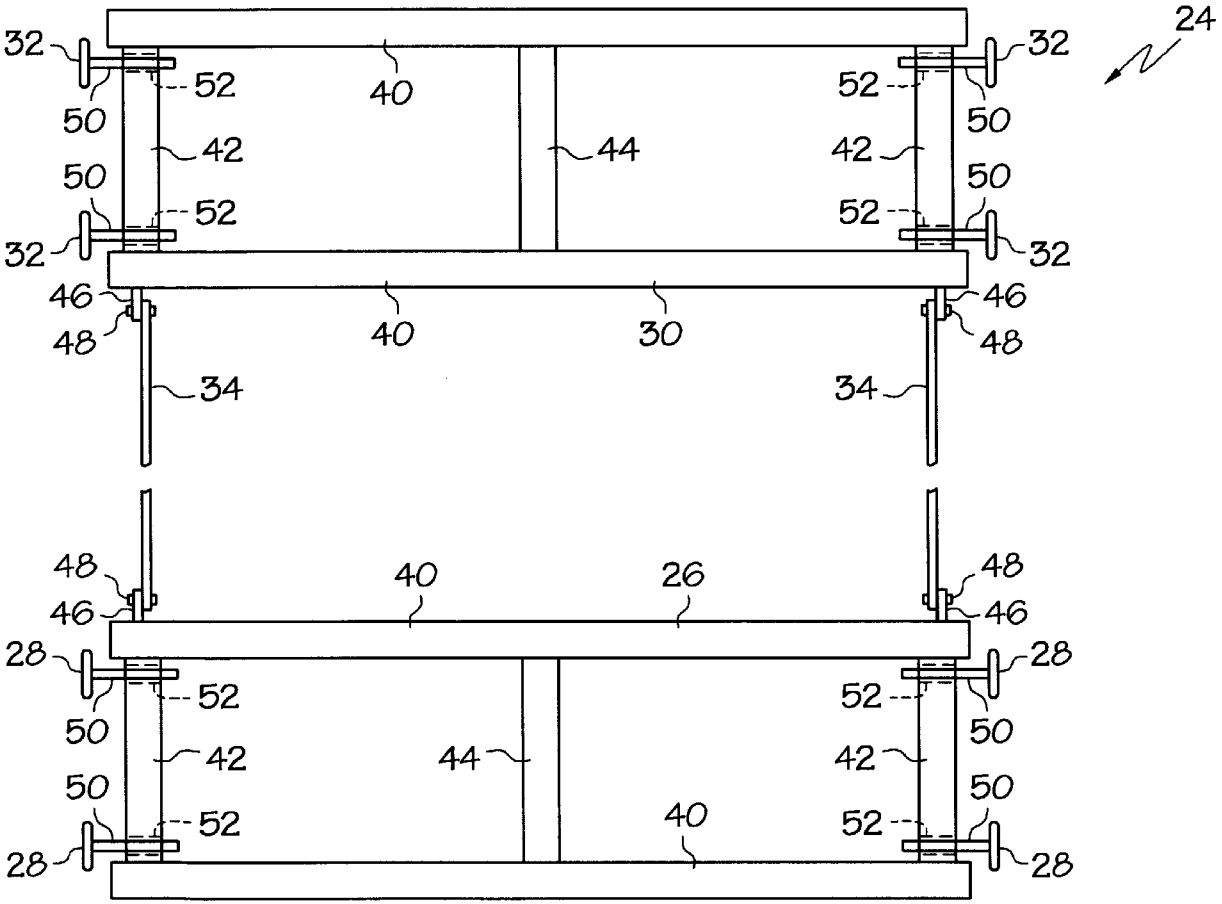
FIG. 2A is a top plan view of the multi-segmented barrier gate for use with the present invention.

As shown in FIGS. 1, 2A and 2B, a multi-segmented barrier gate 24 is received within and guided by the guide rails 12. The multi-segmented barrier gate 24 includes a load-in side gate segment 26 having two opposing lateral pairs of guide rollers/wheels 28 received within and guided by the guide rails 12; a handling side gate segment 30 having two opposing lateral pairs of guide rollers/wheels 32 received within and guided by the guide rails 12; and a pair of cross bars, pivotally interconnecting the load-in side gate segment 26 and the handling side gate segment 30.

In FIG. 1, the load-in side gate segment 26 is in a barrier position in which it is positioned entirely within the vertical portions 14 of the rails 12, approximate the load-in side 16 of the elevated loading platform or mezzanine, and provides a barrier for protecting workers from the load-in side edge of the elevated loading platform or mezzanine. The handling side gate segment 30 is positioned in an open position in which it is positioned in the substantially horizontal portions 22 of the guide rails 12, thus providing access to the loading area 11 from the handling side 20 of the loading platform or mezzanine. The handling side gate segment may be guided along the guide rails 12 to a barrier positions, in which it will be positioned entirely within the vertical portions 18 of the rails 12, approximate the handling side 20 of the elevated loading platform or mezzanine, and providing a barrier for preventing access into the loading area 11 by workers. Likewise, the load-in side gate segment 26 may be guided along the rails 12 to an open position, in which it will be positioned in the substantially horizontal portions 22 of the guide rails 12, thus providing access to the loading area 11 for lift trucks on the load-in side 16 of the loading platform or mezzanine. The cross-bars 34 operate to push the handling side gate segment 30 from its open position to its barrier position when the load-in side gate segment 26 is lifted from its barrier position to its open position. Likewise the cross-bars 34 operate to push the load-in side gate segment 26 from its open position to its barrier position when the handling side gate segment 30 is lifted from its barrier position to its open position.

While the open position of the load-in side and handling side gate segments 26, 30 is shown in FIG. 1 as being positioned completely within the horizontal portions 22 of the guide rails 12, it is within the scope of the invention that the open positions of the gate segments can include positioning at least a portion of the gate segments within the horizontal portions 22 of the guide rails or in the curved portions of the guide rails between the horizontal and vertical portions of the guide rails. Furthermore, while each of the guide rails 12 are shown as being shaped as an inverted U, it is within the scope of the invention to remove a small middle section of the horizontal portion 22 that is not necessary for use with the present invention, leaving two inverted L-shaped rails for each of the guide rails 12.

Preferably, the vertical portions 14, 18 of the guide rails include rubber stops mounted within the c-channels of the guide rails that act to maintain the gate segments 26, 30 at a desired height above the floor of the elevated loading platform or mezzanine when in their respective barrier positions. The dimensions of the gate segments 26, 30 and the height above the floor of the elevated loading platform or mezzanine of the gate segments 26, 30 when in their barrier positions may depend upon the local safety codes. Typically, when in their respective barrier positions, the upper edges of the gate segments 26, 30 will be positioned 40–50 inches from the floor of the elevated loading platform or mezzanine and the lower edges of the gate segments will be positioned 20–25 inches from the floor of the elevated loading platform or mezzanine. Nevertheless, it is within the scope of the invention to modify such dimensions and heights depending upon the particular application. Alternately, the stops may be positioned in the horizontal portions 22 of the guide rails to perform the same function. Furthermore, it is within the scope of the invention to use other types and positions of stops available to those of ordinary skill in the art.

It is preferred that a spring 36 is connected between the center portion of a cross-bar 34 and a stationary object 38, such as a mezzanine support beam or post positioned substantially above the reciprocating barrier assembly. Accordingly, the spring 36 acts as a counter balance to assist in the lifting of the gate segments 26, 30 from their respective barrier positions to their respective open positions.

As shown in FIGS. 2A and 2B, in the preferred embodiment, the load-in side and handling side gate segments 26, 30 are preferably rectangular in shape and are constructed from 1¾" 14 and 20 gauge steel tubing. Each gate segment 26, 30 preferably includes a pair of horizontal tubes 40 welded to a pair of vertical tubes 42 at the longitudinal ends of the horizontal tubes to substantially form a triangle. For additional rigidity, each of the gate segments also include a third vertical tube 44 welded between each of the horizontal tubes 40, midway along the longitudinal length of the horizontal tubing segments. Each of the horizontal tubes adjacent to the cross-bars 34 include a pair of metal tabs 46 extending therefrom for receiving a pin 48 extending through the tab and cross-bar, for pivotally connecting the respective gate segments 26, 30 to the cross-bar segments 34. In the preferred embodiment the cross-bar segments 34 are preferably one inch by one-quarter inch flat steel bars. The rollers/wheels 28, 32 are mounted for free rotation on shafts 50, which are in turn freely slidably within protecting sleeves or bushings 52 extending through the vertical tubes 42 of the gates 26, 30. In the preferred embodiment, the wheels/rollers are 3" rollers.

Figure 3B:
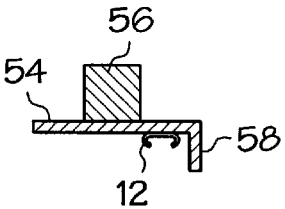
FIG. 3B is a cross-sectional view of the guide rail, support plate and frame segment taken along lines 3B—3B of FIG. 3A.
Figure 3A:
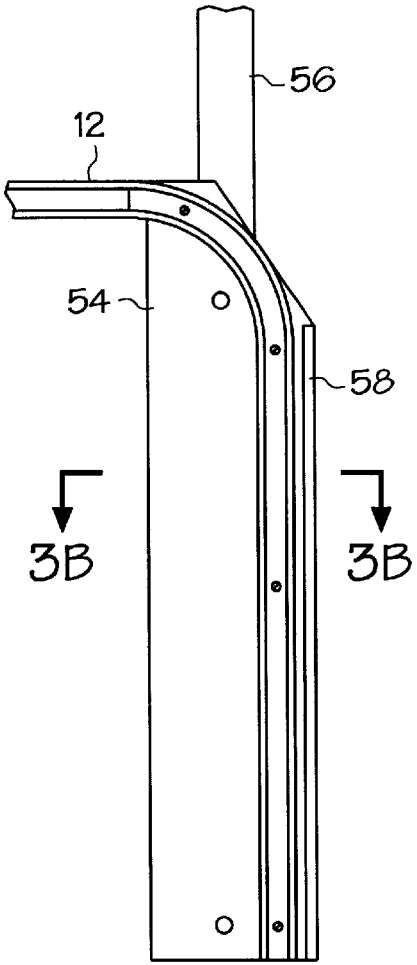
FIG. 3A is an elevational side view of portion of the inverted U-shaped guide rail coupled to a support plate and mezzanine frame.

As shown in FIGS. 3A and 3B, the vertical portions of the guide rails 12 are preferably connected to a protective support plate 54 on the closed side of the guide rails (by flathead screws, for example). The protective support plates 54 are in turn preferably bolted to the frame 56 (such as a post) of the mezzanine or loading platform. The protective support plates 54 include a contact plate 58 extending at a right angle from the support plate 54 in front of the C-channel guide rail 12, thereby preventing damage to the guide rails caused by the tines of the forklift truck, for example.

Figure 4:
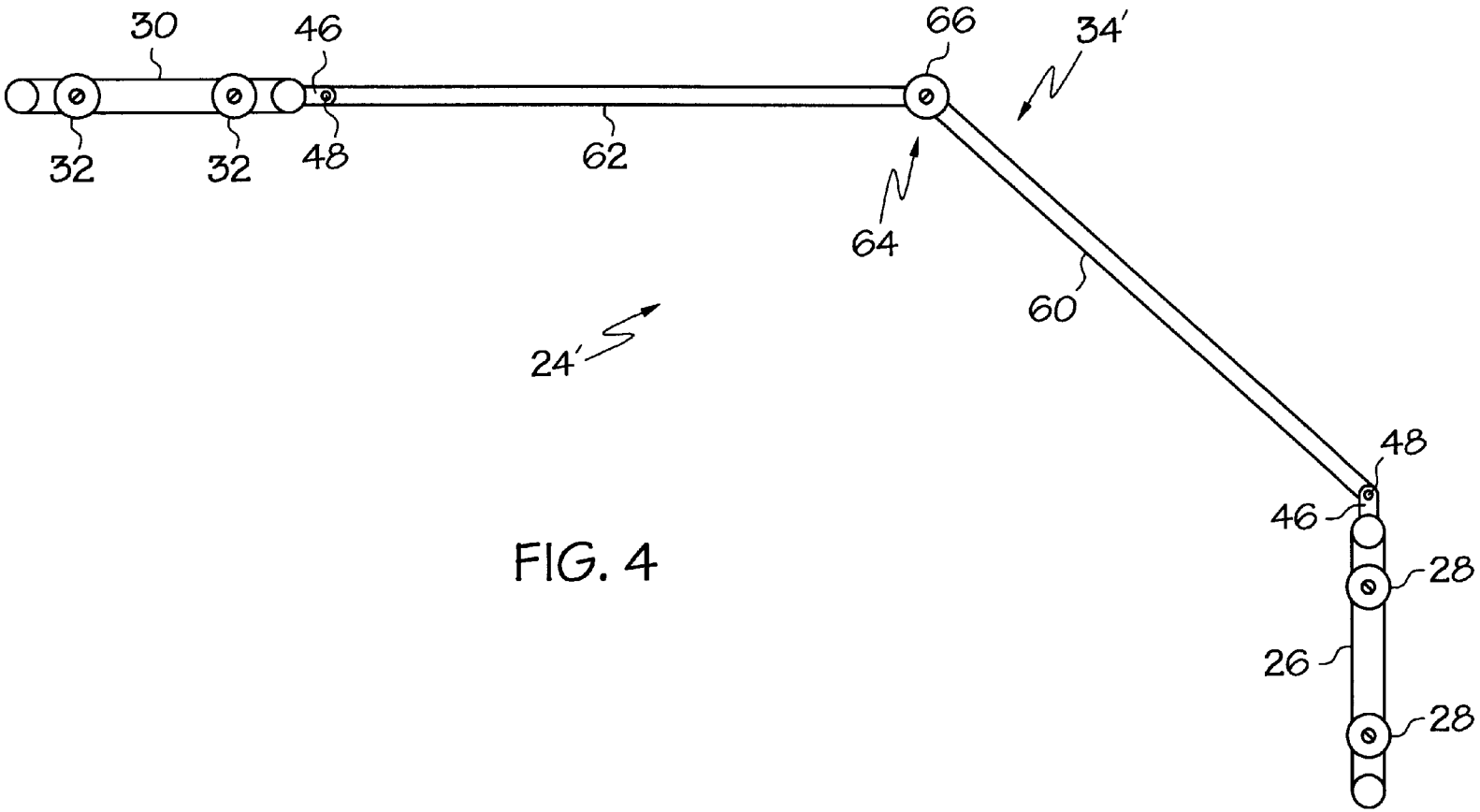
FIG. 4 illustrates an elevated side view of an alternate embodiment of the multi-segmented barrier gate for use with the present invention.
Figure 5:
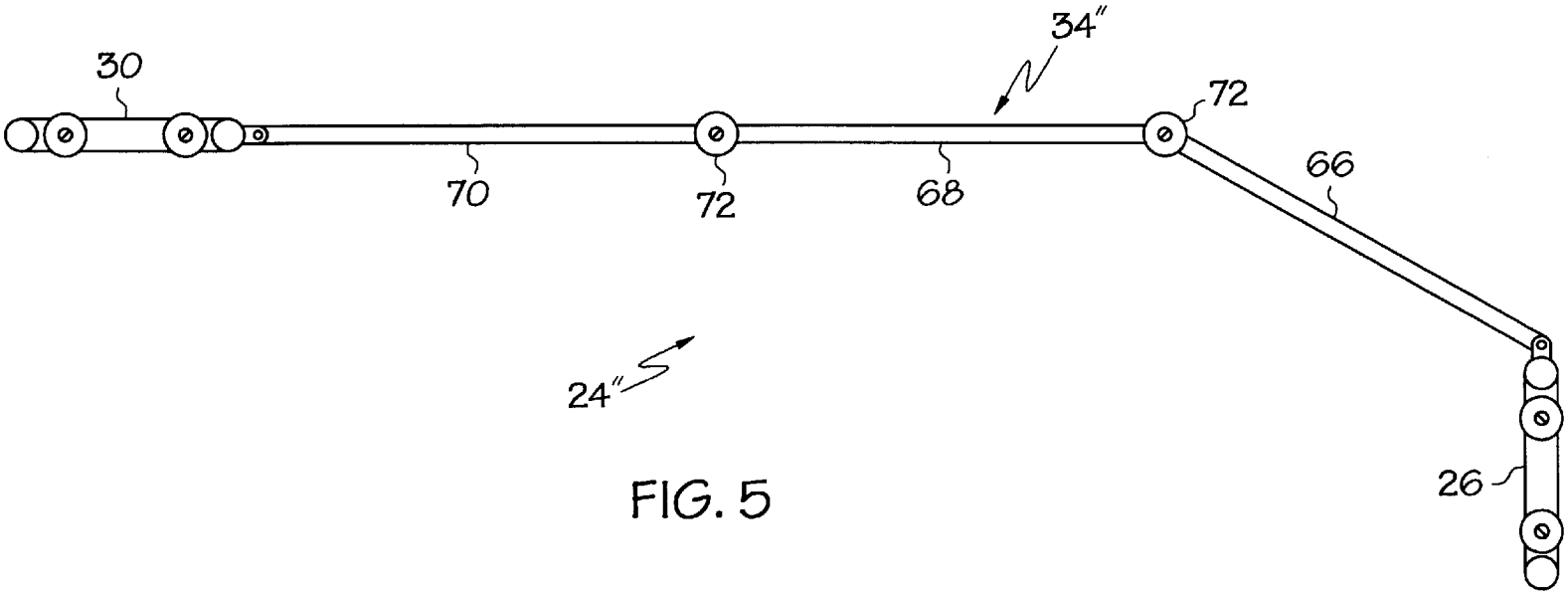
FIG. 5 illustrates an elevated side view of yet another alternate embodiment of the multi-segmented barrier gate for use with the present invention.

As shown in FIG. 4, an alternate embodiment of the of the multi-segmented barrier gate 24' includes a pair of segmented cross-bars 34'. Each of the segmented cross-bars 34' include a pair of rigid cross-bar segments 60, 62, where the first cross-bar segment 60 is pivotally coupled to the load-in side gate segment 26, where the second cross-bar segment 62 is pivotally coupled to the handling side gate segment 30 and where the two cross-bar segments are pivotally coupled to each other between the load-in side and handling side gate segments. Preferably, the pivot point 64, where the two cross bar segments 60, 62 are pivotally coupled together, includes a guide roller/wheel that is received within the guide rails (not shown). This embodiment is designed for longer loading areas 11 of the elevated loading platform or mezzanine, where the horizontal portions 22 of the guide rails will be lengthened to correspond with the length of the loading area. Of course, it is within the scope of the invention to add more segments to the segmented cross-bars to accommodate even longer loading platforms. For example, as shown in FIG. 5, yet another alternate embodiment of the multi-segmented barrier gate 24" includes a pair of segmented cross-bars 34", where each of the segmented cross-bars 34" include three rigid cross-bar segments 66, 68 & 70, and where the pivotal connections between the cross-bar segments include guide rollers/wheels 72 that are received within the guide rails (not shown).

While the forms of apparatus herein described constitute preferred embodiments of the invention, it is to be understood that the invention is not limited to these precise forms of apparatus, and that changes may be made therein without departing from the scope of the invention as defined by the following claims.

What is claimed is:

1. A barrier assembly for protecting a loading platform, the loading platform having a loading edge and a personnel entrance distal from and substantially parallel to the loading edge, the barrier assembly comprising:

a pair of parallel guide rails, each shaped generally as an inverted-U, each having a first substantially vertical portion, a second substantially vertical portion opposite the first substantially vertical portion and a substantially horizontal portion interconnecting the first and second substantially vertical portions;

a first gate segment having at least one pair of rollers positioned on opposite lateral sides thereof, each roller being received within a respective one of the guide rails so that the fist gate segment is guided by the pair of guide rails;

a second gate segment having at least one pair of rollers positioned on opposite lateral sides thereof, each roller being received within a respective one of the guide rails so that the second gate segment is guided by the pair of guide rails; and at least one substantially rigid first cross-bar pivotally connected between the first and second gate segments, wherein the first cross-bar is free to reciprocate with respect to the guide rails in a path that is at least partially horizontal;

the first gate segment being guided by the pair of guide rails from a barrier position in which the first gate segment is positioned entirely within the first substantially vertical portions of the pair of guide rails to an open position in which the first gate segment is positioned at least partially in the substantially horizontal portions of the pair of guide rails;

the second gate segment being guided by the pair of guide rails from a barrier position in which the second gate segment is positioned entirely within the second substantially vertical portions of the pair of guide rails to an open position where the second gate segment is positioned at least partially in the substantially horizontal portions of the pair of guide rails; and the first cross-bar having a length which requires that when the first gate segment is in its barrier position the second gate segment will be in its open position, and vice-versa.

2. The barrier assembly of claim 1, wherein the first cross-bar is pivotally connected between the first and second gate segments adjacent to a first lateral edge of the first and second gate segments.

3. The barrier assembly of claim 2, wherein the first cross-bar is pivotally coupled to the first and second gate segments.

4. The barrier assembly of claim 3, wherein the first cross-bar is pivotally coupled to the first and second gate segments by hinges.

5. The barrier assembly of claim 2 further comprising a second cross-bar pivotally connected between the first and second gate segments adjacent to a second lateral edge of the first and second gate segments.

6. The barrier assembly of claim 5, wherein:

the first gate segment includes a second pair of guide rollers positioned on opposite lateral sides thereof, each of the second pair of guide rollers being received within a respective one of the pair of guide rails; and the second gate segment includes a second pair of guide rollers positioned on opposite lateral sides thereof, each of the second pair of guide rollers being received within a corresponding one of the pair of guide rails.

7. The barrier assembly of claim 1, further comprising:

a first stop coupled to the first substantially vertical portion of at least one of the pair of guide rails and restricting downward movement of the first gate segment when the first gate segment is in its barrier position, and a second stop coupled to the second substantially vertical portion of at least one of the pair of guide rails and restricting downward movement of the second gate segment when the second gate segment is in its barrier position.

8. The barrier assembly of claim 7, wherein the first and second gate segments are generally rectangular shaped, each having an upper edge, and wherein an upper edge of each of the first and second gate segments are adapted to be approximately 40 to 50 inches from a floor of the loading platform when in their respective barrier positions.

9. The barrier assembly of claim 8, wherein each of the first and second gate segments include a horizontal top rail and a horizontal bottom rail welded to a pair of vertical side rails, and wherein the horizontal top rails of the first and second gate segments are adapted to be approximately 40 to 50 inches from the floor of the loading platform when in their respective barrier positions.

10. The barrier assembly of claim 9, wherein one of the horizontal bottom rails of each of the first and second gate segment are adapted to be approximately 20 to 25 inches from the floor of the loading platform when in their respective barrier positions.

11. The barrier assembly of claim 1, further comprising:

a first stop coupled to one of the pair of guide rails and restricting downward movement of the first gate segment when the first gate segment is in its barrier position, and a second stop coupled to one of the pair of guide rails and restricting downward movement of the second gate segment when the second gate segment is in its barrier position.

12. The barrier assembly of claim 11, wherein the first and second gate segments are generally rectangular shaped, each having an upper edge, and wherein the upper edge of each of the first and second gate segments are adapted to be approximately 40 to 50 inches from a floor of the loading platform when in their respective barrier positions.

13. The barrier assembly of claim 1, further comprising:

a stationary support elevated above the horizontal portions of the pair of guide rails; and a spring mounted between the stationary support and the cross-bar, to reduce an amount of force needed to lift the first and second gate segments when in the respective first and second substantially vertical portions of the pair of guide rails.

14. The barrier assembly of claim 1, further comprising a contact plate extending in front of the first substantially vertical portions of the guide rails.

15. A barrier assembly for protecting a loading platform, the loading platform having a loading edge and a personnel entrance distal from and substantially parallel to the loading edge, the barrier assembly comprising:

a pair of guide rails, each having a first substantially vertical portion, a second substantially vertical portion opposite the first substantially vertical portion, a substantially horizontal portion extending between top ends of the first and second substantially vertical portions and a pair of curved portions connecting the first and second substantially vertical portions to the substantially horizontal portion;

a first gate segment having at least one pair of rollers positioned on opposite lateral sides thereof, each roller being received within a respective one of the guide rails so that the first gate segment is guided by the pair of guide rails;

a second gate segment having at least one pair of rollers positioned on opposite lateral sides thereof, each roller being received within a respective one of the guide rails so that the second gate segment is guided by the pair of guide rails; and at least one substantially rigid first cross-bar pivotally connected between the first and second gate segments, wherein the first cross-bar is free to reciprocate with respect to the guide rails in a path that is at least partially horizontal;

the cross-bar being of sufficient length so that when the first gate segment is positioned completely within the first substantially vertical portions of the pair of guide rails, the second gate segment will be positioned at least partially within the substantially horizontal portions or the curved portions connecting the second substantially vertical portions to the substantially horizontal portions of the pair of guide rails, and likewise, when the second gate segment is positioned completely within the second substantially vertical portions of the pair of guide rails, the first gate segment will be positioned at least partially within the substantially horizontal portions or the curved portions connecting the first substantially vertical portions to the substantially horizontal portions of the pair of guide rails.

16. A barrier assembly for protecting a loading platform, the loading platform having a loading edge and a personnel entrance distal from and substantially parallel to the loading edge, the barrier assembly comprising:

a pair of parallel guide rails, each shaped generally as an inverted-U, each having a first substantially vertical portion, a second substantially vertical portion opposite the first substantially vertical portion and a substantially horizontal portion interconnecting the first and second substantially vertical portions;

a first gate segment having at least one pair of rollers positioned on opposite lateral sides thereof, each roller being received within a respective one of the guide rails so that the first gate segment is guided by the pair of guide rails;

a second gate segment having at least one pair of rollers positioned on opposite lateral sides thereof, each roller being received within a respective one of the guide rails so that the second gate segment is guided by the pair of guide rails; and a segmented cross-bar pivotally coupled between the first and second gate segments, the segmented cross-bar including a plurality of substantially rigid cross-bars pivotally coupled together in series, each pivotal coupling between the substantially rigid cross-bars including a roller that is received within and guided by one of the guide rails.

17. A barrier assembly for protecting a loading platform, the loading platform having a loading edge and a personnel entrance distal from and substantially parallel to the loading edge, the barrier assembly comprising:

a pair of parallel guide rails, each shaped generally as an inverted-U, each having a first substantially vertical portion, a second substantially vertical portion opposite the first substantially vertical portion and a substantially horizontal portion interconnecting the first and second substantially vertical portions;

a first gate segment having at least one pair of rollers positioned on opposite lateral sides thereof, each roller being received within a respective one of the guide rails so that the first gate segment is guided by the pair of guide rails;

a second gate segment having at least one pair of rollers positioned on opposite lateral sides thereof, each roller being received within a respective one of the guide rails so that the second gate segment is guided by the pair of guide rails; and at least one substantially rigid cross-bar pivotally connected between the first and second gate segments, the cross-bar being movable to and away from the first and second substantially vertical portions of the guide rails in a path having a horizontal component, thereby permitting the first and second gate segments to be guided, at least partially, into the substantially horizontal portions of the guide rails.

* * * * *

UNITED STATES PATENT AND TRADEMARK OFFICE

CERTIFICATE OF CORRECTION

PATENT NO. : 6,212,826 B1
DATED : April 10, 2001
INVENTOR(S) : Tom Kimener

It is certified that error appears in the above-identified patent and that said Letters Patent is hereby corrected as shown below:

Claim 1, column 6,
Line 14, the word "fist" should be -- first --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*